US005175906A

United States Patent [19]

Holter

[11] Patent Number: 5,175,906

[45] Date of Patent: Jan. 5, 1993

[54] BEAN CLEANING APPARATUS

[75] Inventor: Larry G. Holter, Alvarado, Minn.

[73] Assignee: Agricon, Inc., Grand Forks, N. Dak.

[21] Appl. No.: 531,945

[22] Filed: Jun. 1, 1990

[51] Int. Cl.[5] ..... B07B 1/15

[52] U.S. Cl. ..... 15/3.16; 15/3.1; 15/3.11; 209/618

[58] Field of Search ..... 15/3.10, 3.11, 3.13, 15/3.14, 3.16, 3.20, 3.21; 209/308, 315

[56] References Cited

U.S. PATENT DOCUMENTS

| | | | |
|---|---|---|---|
| 616,284 | 12/1898 | Baker et al. | 15/3.16 |
| 839,415 | 12/1906 | Owens | 209/315 |
| 842,378 | 1/1907 | Baker | 15/3.16 |
| 2,234,766 | 3/1941 | Kennedy et al. | 15/3.12 |
| 2,877,475 | 3/1959 | Henry | 15/3.16 |
| 4,471,876 | 9/1984 | Stevenson, Jr. et al. | 15/3.11 |

FOREIGN PATENT DOCUMENTS

| | | | |
|---|---|---|---|
| 471620 | 5/1952 | Italy | 15/3.16 |

*Primary Examiner*—Philip R. Coe
*Assistant Examiner*—Patrick F. Beinson
*Attorney, Agent, or Firm*—Robert E. Kleve

[57] ABSTRACT

The invention comprises a bean cleaning apparatus comprising a plurality of pairs of elongated inclined rotating parallel rods. One of the rods in each pair has a spiral groove along its length and the other rod has a smooth cylindrical outer surface. The rods in each pair are mounted to a frame with a space between the rods in each pair narrower than a small bean and with the one rod in its rotation spiralling doward so as to auger the beans downward along the rods. The rods in their rotation in each pair rotating toward one another to move the beans toward the rods and with the engagement of the rods with the beans acting as a abresion to the outer surface of the beans to clean the beans of foreign matter as it moves along with the space allowing small particles of foreign matter to pass between the rods.

2 Claims, 3 Drawing Sheets

BEAN CLEANING APPARATUS

This invention relates to cleaning apparatus.

It is an object of the invention to provide a novel bean cleaning apparatus that has a plurality of pairs of elongated inclined rotating rods with one of the rods in each pair having a spiral groove along its length and the other of the rods having a smooth cylindrical surface and with the rods in each pair having a narrow space between them narrower than a small bean, and with the one rod in its rotation spiralling downward so as to auger the beans downward along the rods and with the rod rotating toward one another to move the beans toward the rods and with the engagement of the rods with the beans acting as an abrasion to the outer surface of the bean to clean the bean of foreign matter as it moves along.

It is a further object of the invention to provide a novel bean cleaning apparatus for cleaning beans and other small objects having a hard smooth rounded outer surface, with the apparatus having a plurality of pairs of parallel rotating rods with one of the rods in each pair having a spiral screw outer surface to auger the beans from one end of the rods to the other end while directing the beans against the other rotating rod of the pair to provide frictional contact between the rods and the beans for cleaning the beans as they are augered along.

It is another object of the invention to provide a novel bean cleaning apparatus that can be easily operated for cleaning a relatively large volume or quantity of beans rapidly.

It is another object of the invention to provide a novel cleaning apparatus for cleaning quantities of small objects by removing foreign particles therefrom.

Further objects and advantages of the invention will become apparent as the description proceeds and when taken in conjunction with the accompanying drawings wherein.

Briefly stated, the invention comprises a bean cleaning device having a plurality of pairs of elongated rods, one of said rods in each pair having a spiral groove along its length and the other having a smooth cylindrical outer surface, said rods having their one ends mounted on a frame higher than their other ends with the rods being mounted in each pair in parallel spaced relation to one another, a plate means deflecting beans applied to the device onto the rods in each pair adjacent the space between the rods in each pair, said rods in each pair being rotatably powered to rotate axially downward and toward one another, with the spiral groove in the one rod acting to move the beans axially along the rods adjacent the space, and with the engagement of the rods in their rotation with the beans acting to remove dirt adhering to the beans so that the dirt may drop down between the rods through the space and with the space being narrower than a small beans so that the beans move axially along the rods to thereby clean the beans.

Figure 2:
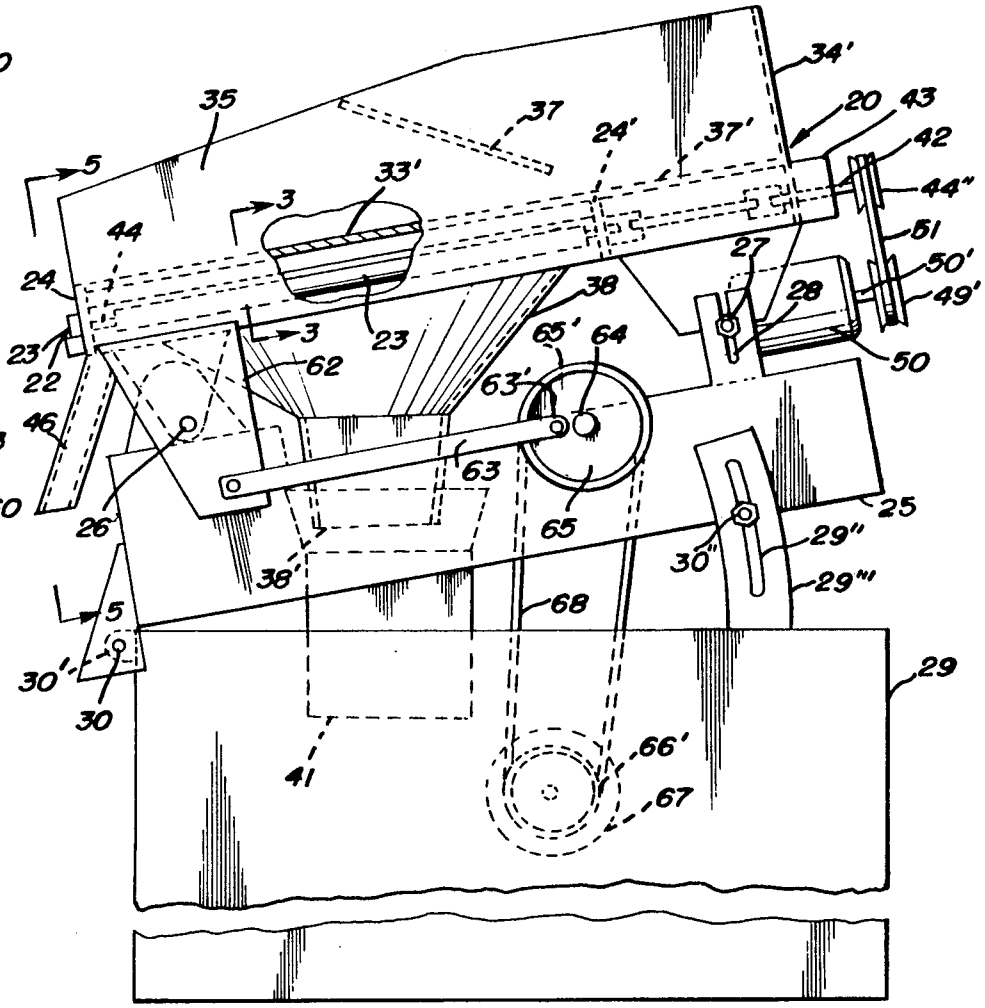
FIG. 2 is a side elevational view of the bean cleaning invention or device.
Figure 1:
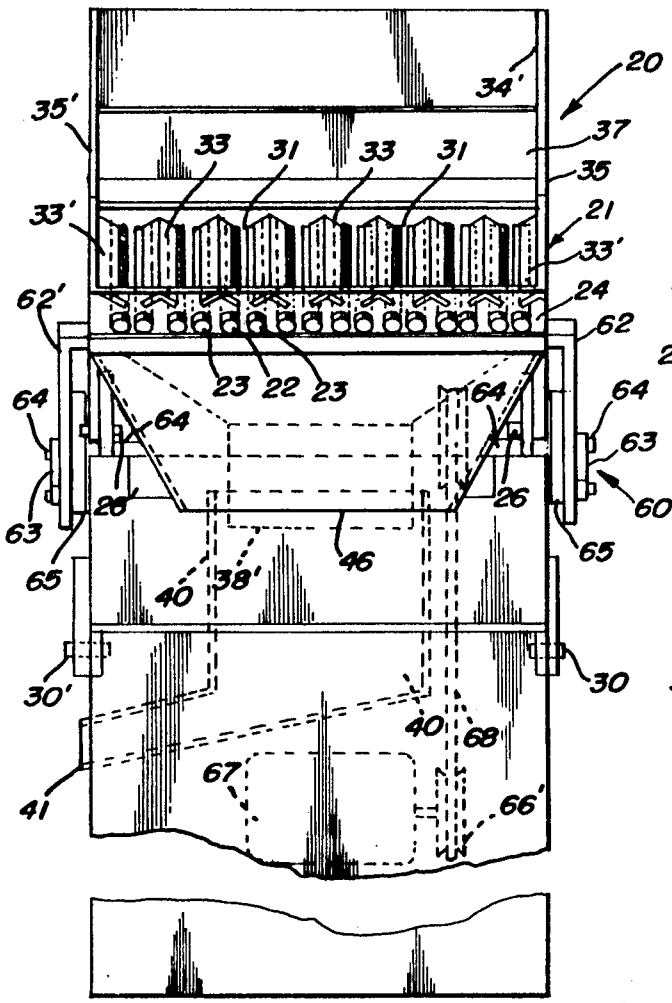
FIG. 1 is a front elevational view of the bean cleaning device.

Referring more particularly to the drawings, in FIG. 1, the bean cleaning apparatus 20 is illustrated having an inclined rectangular frame 21 with a plurality of pairs of elongated rollers or rods 22 and 23 in parallel relation to one another rotatably mounted in end plates 24 and 24' of the frame 21. The inclined rectangular frame 21 is mounted to an intermediate frame 25 in parallel relation, being pivotally mounted to the intermediate frame about pivot points 26 and 26' at one end and connected by a pin 27 fixed to frame 21 mounted in a slot 28 in a plate 28' fixed to the intermediate frame, the pin being free to move in the slot so that the frame 21 can pivot relative to frame 25. Frame 25 is pivotally mounted to the frame 29 by pivot points 30 and 30', and is adjusted to a stationary inclined position by loosening of the bolt 30'' and retightening the bolt to hold the frame 25 at an angle, with the bolt being adjusted in position in the slots 29'' in plates 29'' fixed to the frame 29. The adjusting of the intermediate frame 25 thereby adjusts the frame 21 to a selected angle to the frame 29.

Each pair of rotary rods or rollers 22 and 23 of the frame 21 has one rod 22 with a spiral groove 22' along its length in its outer surface for augering the beans axially along the rods downward to the lower ends of the rods. The other rod 23 in each pair has a smooth cylindrical surface. The rods 22 and 23, in each pair, are mounted to the frame with a narrow space 31 therebetween. A space 32 is also provided between each pair of rods 22 and 23.

A plurality of inverted V-shaped elongated plates 33 are each mounted at their ends to the end plates 24 and 24' of the frame above the rods 22 and 23 and above the space 32 between the rods in each pair. The plates 33 incline downward toward the narrow space 31 between the rods in each pair.

A pair of inclined half plates 33' are also mounted between the end plates 24 and 24', one at each end of the row of inverted V shaped Plates.

A feed hopper plate 37 is mounted between the side plates 35 and 35' fixed to the frame 21 to direct beans to be cleaned onto the upper ends of the rods 22 and 23. A upright back wall 34' is fixed between plates 35 and 35'.

The rods 22 and 23, in each pair, are mounted to the frame 21 with their upper ends rotatably mounted in bearing in the lateral plate 24 and extend therethrough. Collars 36 are mounted to the upper ends of the rods on the upper side of the plate 24. The collars 36 in turn are mounted to flexible plastic rods 37'' at one ends of the plastic rods. The plastic rods at their other ends 37'' are mounted to upper collars 38. The collars 38 have reduced shaft portions extending through a lateral plate 40 in the frame 21. Toothed gears 41 are fixed to the outer ends of the shafts of the collars and the gears engage one another and are of equal diameter, to rotate the rods at equal speed and so the gears will rotate in alternate directions. The gear 41' has its shaft 42 extending through the front plate 34' of the front 43 of the frame and a pulley 44'' is fixed to the outer end of the shaft 42.

An electric motor 50 is fixed to the frame 21 beneath the rods 22 and 23 and plastic shafts for powering the rotation of the pairs of rods 22 and 23 on the frame 21. The motor 50 has an output shaft 50' with a pulley 49' fixed to the shaft 50', and a pulley belt 51 connecting the pulleys so that activation of the motor rotates the pulleys which rotates the gear 41', which in turn rotates the gears 41 in alternating fashion as indicated by the arrows to thereby rotate the plastic shafts and thereby rotate the rods 22 and 23 in alternating fashion in the directions indicated by the same arrows.

The plastic shafts enable the shafts to flex outward from their engagement with the ends of the rods 22 and 23 to they engage and mount to the toothed gears 41, so that convenient size gears of equal diameter may be engaged with one another for equal rotation of the rods at a suitable speed in alternating direction. Plate 37' covers collars 36 and 38 and rods 37, it being fixed between plates 35 and 35'.

OPERATION

Beans to be cleaned will be fed onto the feed hopper plate 37, which will direct the beans onto the upper ends of rods 22 and 23 and onto inverted V-shaped plates 33, which also deflects the beans onto the open halves of the rods 22 and 23 immediately adjacent the space 32 at the upper ends of the rods 22 and 23 on frame 21. Thus some of the beans from the hopper fall directly onto the open halves of rods 22 and 23, namely the halves of the rods not covered by the V plates. Some of the beans fall onto the V plates and half plates 33', and are deflected by these plates onto the open halves of rods 22 and 23, while some will fall onto plate 37' and gravitate downward onto plates 33 and into open halves of rods 22 and 23 for the cleaning operation.

Figure 3:
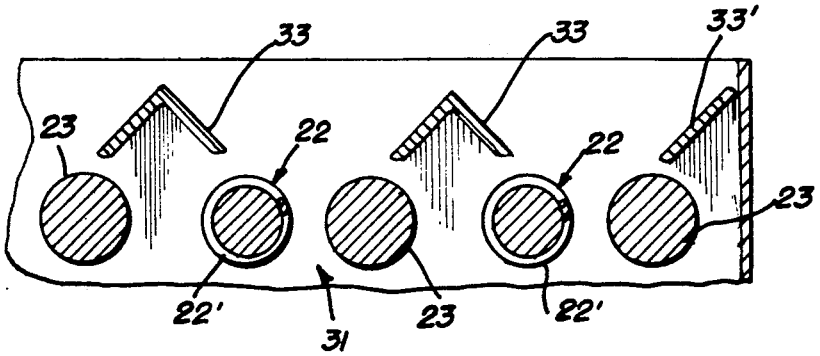
FIG. 3 is an enlarged fragmentary view taken along line 3—3 of FIG. 2.
Figure 4:
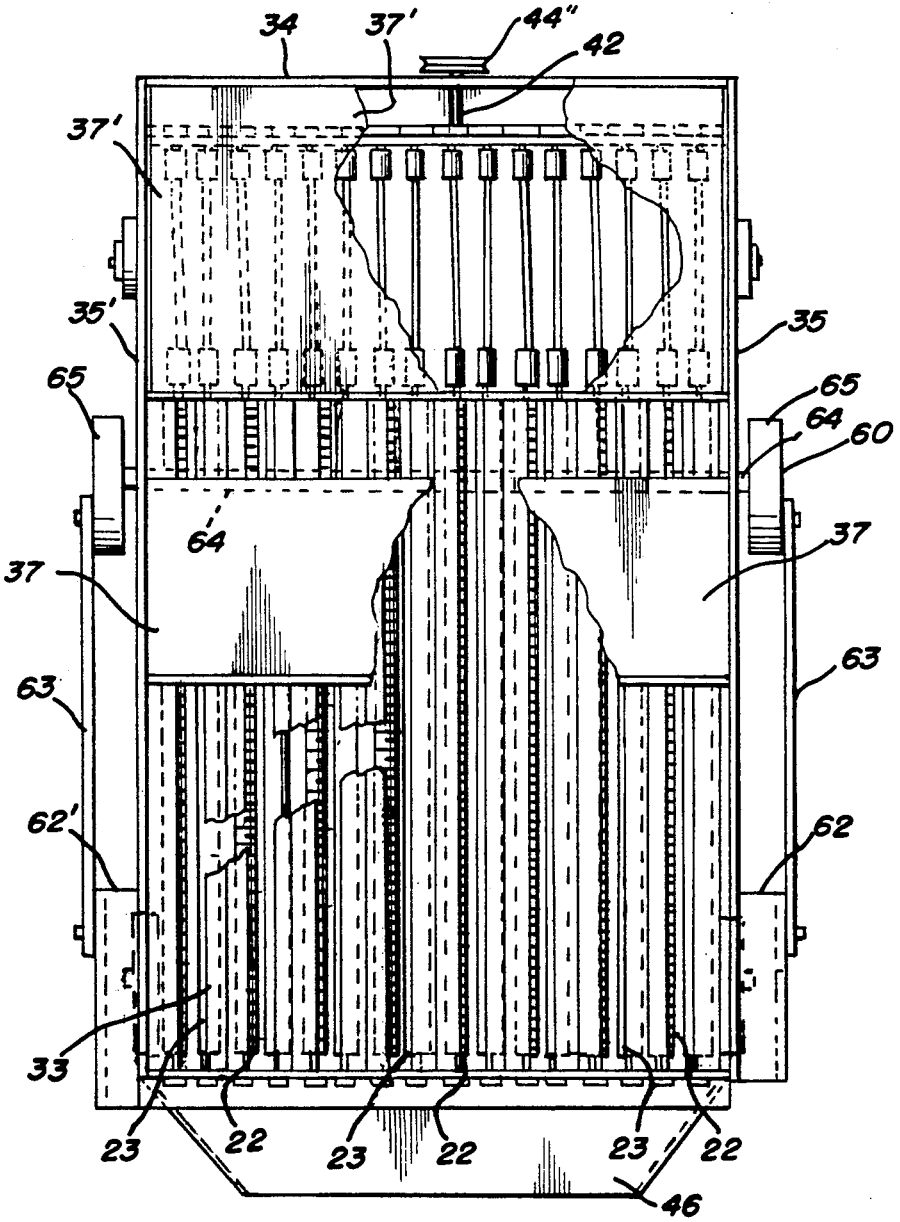
FIG. 4 is a top plan view of the bean cleaning device.
Figure 5:
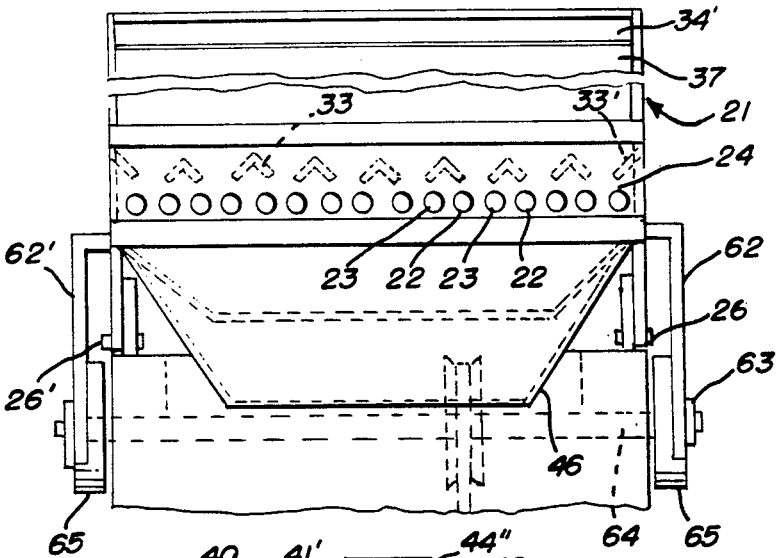
FIG. 5 is a fragmentary front elevational view taken along line 5—5 of FIG. 2.
Figure 6:
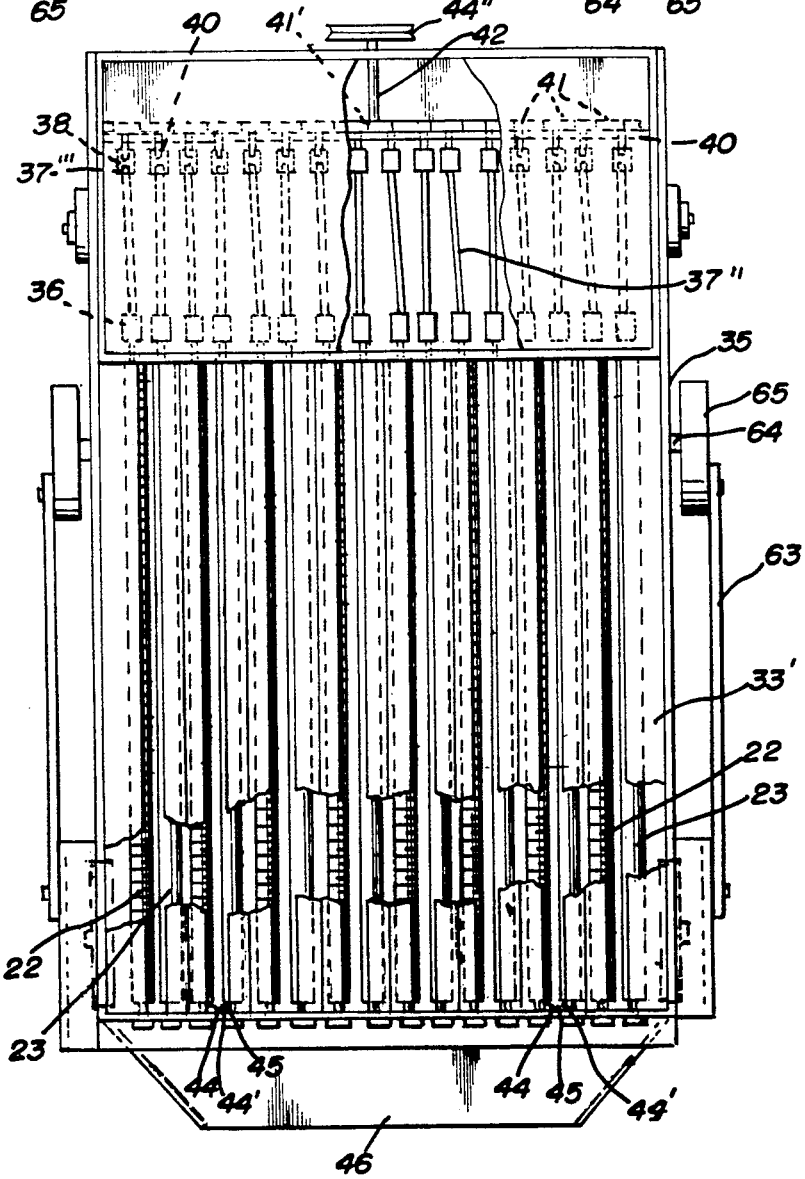
FIG. 6 is an enlarged fragmentary top plan view of the bean cleaning device with portions cut away.

Each pair of rods 22 and 23 in frame 21 rotate in opposed relation downward toward one another and toward the open space 32 between the rods 22 and 23. The spiral grooved rods 22 rotate clockwise and the smooth cylindrical rods 23 rotate counterclockwise, when viewed from FIGS. 1 and 3. The pitch of the spiral grooves 22' in rods 22 is downward and to the left, when viewed from FIG. 1, so that the rotation of the spiral rods clockwise, when viewed from FIG. 3, results in the edges of the rods 22 that form the spiral grooves urging the beans downward and toward space 32 and toward rods 23. Since, however, the beans cannot travel through the space 32 between the rods 22 and 23, the axial downward portion of the force of the rotational movement of the edges of the rods against the beans causes the beans to move downward along rods, parallel to the longitudinal rotational axes of the rods, to the lower ends of the rods 22 and 23, as well as causes the beans to move against one another and against the rods during their downward movement, which causes an abrasive action between the beans and the rods to clean the beans of dirt adhering thereto.

Half plates 33' serve a purpose similar to their corresponding halves of plates 33, namely to deflect the beans onto the open halves of rods 22 and 23. Also, the inverted V-shaped plates 33 and half plates 33' are mounted close enough to the rods 22 and 23 to prevent relatively small beans from passing between the plates 33 and 33' and the rods 22 and 23. Only an occasional very small bean might pass therebetween which would be of no consequence in its operation.

The action of the spiral edges of the grooves of the rod 22 against the beans as well as the action of the rotating rod 23 engaging against the beans and the beans being pushed together by the rods 22 and 23 cause an abrasive action upon the beans which in turn causes particles of dirt adhering to the beans to be broken free, and gravity will thereafter cause the dirt particles to drop down through the space 31, to thereby clean the beans while the beans travel along the tops of the rods 22 and 23 to the lower ends of the rods 22 and 23.

By the time the beans reach the lower ends of the rods 22 and 23, they will customarily have been satisfactorily cleaned of any dirt particles among or adhering to the beans, having been abrasively cleaned by contact with the grooved edges of the one rod 22 and/or contact with the other beans and the other rod 23 for a long enough period of time to customarily clean the beans.

The rods 22 and 23 have reduced diameter surfaces 44 and 44' at their lower ends, so that the space between the rods or rollers 22 and 23 at this point 45 is significantly greater in width than a conventional size bean and greater than the space 31 above, so that the beans of various sizes can now at the lower ends of the rods 22 and 23, after being cleaned, easily drop down between the rods 22 and 23.

A chute 46 is mounted to the frame 21 to receive the beans after they have been cleaned and have dropped down through the space 45 at the reduced diameters of the rods 22 and 23. The chute can channel the cleaned beans away for subsequent other purposes.

The upper frame 21 is pivotally mounted to the intermediate frame 25 with a powered oscillation mechanism 60 connecting the two frames together to oscillate the frame back and forth pivoting about pivot points 26 and 26' with the pin 27 sliding up and down in slot 28 to provide a shaking motion. The mechanism has a pair of plates 62 and 62' fixed to the side of the frame 21 and extending downward on each side. A pitman arm 63 is mounted to each plate 62 and 62' at their one ends. A shaft 64 is rotatably mounted to frame 25 and extends laterally across the frame. A disc 65 is mounted to each end of the shaft and the pitman arms have their other ends rotatably mounted to the discs at a location 67, which is slightly off center to the rotational axis of the shaft 64, so that rotation of the shaft 64 rotates the discs 65 which causes the pitman arm to move back and forth because of its off center location, to pivot the upper frame 21 back and forth slightly and rapidly about its pivot points 26 and 26' to the intermediate frame to provide a shaking motion to the upper frame relative to the intermediate frame.

The shaking motion is provided to assure that the beans keep traveling down the rods 22 and 23 of the upper frame and to keep them from jamming or stopping, and to thereby cause the beans to continue to travel down the rods and into the chute.

A hopper 38 is mounted to the frame 21 beneath the rods 22 and 23 along their length and width and is fixed to receive the dirt and other foreign matter that has been adhering to or among the beans. Contact and crushing action of the spiral grooved edges of the spiral rod has broken off or ground up or crushed the dirt and other foreign matter to small enough particles that they can drop through the opening 33 between the rods 22 and 23. The hopper 38 has a reduced lower end 38' which feeds the dirt and other foreign matter into a second hopper 40 fixed to the bottom frame 29, and the outlet 41 of the second hopper opens out along the side of the bottom frame, so that the dirt can travel out from the first hopper through the second hopper and out into a suitable receptacle (not shown) placed at the outlet, for example.

To power the shaking motion of the upper frame, the shaft 64 has a pulley 65' fixed thereto and a motor 67 is fixed to the bottom frame 29 and has a pulley 66' fixed to the output shaft of the motor 67, with a belt 68 connecting the pulleys, so that rotation of the motor and output shaft rotates the pulleys which rotates the shaft to thereby cause the pitman arms to oscillate back and forth and thereby oscillate the upper frame back and forth providing the shaking motion.

Thus it will be seen that a novel bean cleaning apparatus has been provided for cleaning beans and other similar objects quickly and rapidly, particularly dry, edible beans.

The shaking motion helps to cause the dirt to drop down so that they reach the rotating rods and the rods can crush the dirt into small particles to enable the dirt to drop through the narrow space and also assists in causing the dirt to drop on out the hopper 38.

The pinching of the rods or rollers tends to crush foreign objects such as dirt. While the spiral grooves are sharp enough to grasp and crush dirt particles, the spiral grooves are not sharp enough to cut or crush the beans, and the diameter of the rollers 22 and 23 is kept relatively small on the order of ¼th inch to 2 inches so that the spiral rod is not large enough to crush the beans, such as pinto beans, as might otherwise happen and it is intended that the apparatus be used for cleaning hard type beans having hard smooth outer surfaces such as pinto beans and other similar objects.

It will be obvious that various changes and departures may be made to the invention without departing from the spirit and scope thereof, and accordingly, it is not intended that the invention be limited to that specifically described in the specification or as illustrated in the drawings but only as set forth in the appended claims wherein:

I claim:

1. A bean cleaning device comprising a stationary frame, a movable frame movably mounted relative to the stationary frame, power means to movably agitate and shake said movable frame relative to said stationary frame, a plurality of pairs of inclined elongated rods rotatably mounted in said movably frame and extending in parallel spaced relation to one another in length downward at an angle, said inclined rods in each pair being mounted in said movable frame in narrowly spaced parallel relation to one another along their length with the space being smaller than the customary size pinto beans; hopper means mounted to the movable frame adjacent the upper ends of the rods for feeding the pinto beans onto the the inclined rods with said agitation of the movable frame acting to cause the beans to move longitudinally downward along the rods; one rod in each pair of rods having a cylindrical outer surface with a spiral groove spiralling downward along the one rod; the other rod in each pair of rods having a relatively smooth cylindrical outer surface; power means to rotate the inclined rods axially toward one another in each pair of rods with the spiral in the spiralled rods spiralling downward so as to act, together with the agitation of the movable frame, to move the beans downward along the tops of the rods with the engagement of the beans with the rods being abrasive so as to clean the beans of dirt adhering to the beans as the beans travel downward along the rods; inverted V shaped plates covering a portion of the rods and space between each pair of rods while leaving the narrow space in each pair of rods open to be engaged, cleaned, and conveyed downward along that portion of the rods; said inclined rods having their spiral grooves and smooth outer surfaces along a majority of their length; said inclined rods at their lower ends having reduced outer annular shoulders of reduced size in relation to the outer circumferential size of the rods along the spiral and smooth outer surfaces of the majority of their length, with the reduced shoulders at the lower ends of the rods providing a space between the rods larger than the customary size of pinto beans to enable customary size beans to drop below the rods at the lower ends of the rods; a first chute mounted beneath the majority of the length of the rods for receiving dirt and other particles removed from the beans during their engagement with the spiral and smooth portions of the rods; a second chute mounted beneath the lower ends of the rods for receiving the customary size pinto beans dropping through the larger space at the lower ends of the rods provided by the reduced annular shoulders, after the beans have traveled down the rods.

2. A bean cleaning device comprising a stationary frame, a pivotal frame pivotally mounted to the stationary frame, power operated eccentric cam means to cam said pivotal frame in an oscillatory manner to shake said pivotal frame, a plurality of pairs of elongated inclined rods rotatably mounted for axial rotation in said pivotal frame and extending in parallel spaced relation to one another in length downward at an angle; said inclined rods in each pair being mounted in narrowly spaced parallel relation to one another along their length with the space being smaller than the customary size pinto beans; a hopper mounted to said apparatus at the upper end of the pivotal frame adjacent the upper ends of the rods for feeding pinto beans onto the inclined rods with the shaking of the pivotal frame acting to cause the beans to move longitudinally downward along the rods; one rod in each pair of rods having a cylindrical outer surface with a spiral groove spiralling downward along the one rod; the other rod in each pair of rods having a smooth cylindrical outer surface; power means to rotate said rods axially toward one another in each pair of rods with the spiral in the spirall rods spiralling downward to act, together with the shaking of the pivotal frame, to move the beans downward along the tops of the rods with the engagement of the beans with the rods being abrasive so as to clean the beans of dirt adhering to the beans as the beans travel downward along the rods; inverted V shaped plates acting to cover a portion of the rods and along a space between each pair of rods while leaving the narrow space between the rods in each pair open to be engaged, cleaned, and to convey the beans downward along that portion of the rods, said inclined rods having their spiral grooves and their smooth outer surfaces along a majority of their length; said inclined rods at their lower ends having outer annular shoulders of reduced size in relation to the radial outer circumferential size of the rods along their spiral and smooth outer surfaces of the majority of their length, with the reduced annular shoulders providing a space extending radially between the rods and an axial distance along the rods larger than the customary size of the pinto beans to enable the customary size pinto beans to drop below the rods at the lower ends of the rods, a first chute mounted beneath the majority of the length of the rods for receiving dirt and other particles removed from the beans during their engagement with the spiral and smooth portions of the rods; a second chute mounted beneath the lower ends of the rods for receiving the customary size pinto beans dropping through the larger space at the lower ends of the rods provided by the reduced annular shoulders, after the beans have traveled down the rods, said reduced annular surface of said rods extends extends axially and radially a distance in excess of the radial spacing between the rods in each pair of rods as well as in excess of the customary size of pinto beans.

* * * * *